United States Patent [19]

Bender et al.

[11] Patent Number: 4,950,361

[45] Date of Patent: Aug. 21, 1990

[54] PROCESS FOR CONTROLLING PITCH DEPOSITS IN THE PULP AND PAPERMAKING PROCESSES WITH ZIRCONIUM (IV) COMPOUND

[75] Inventors: Gregory W. Bender, Maple Glen, Pa.; Stan D. Buratto, Vancouver, Wash.; Robert D. Evans, Warminster, Pa.

[73] Assignee: Quaker Chemical Corporation, Conshohocken, Pa.

[21] Appl. No.: 244,728

[22] Filed: Sep. 15, 1988

[51] Int. Cl.[5] ..... D21C 9/08

[52] U.S. Cl. ..... 162/199; 162/DIG. 4; 162/79; 162/181.2; 162/181.3; 162/181.5

[58] Field of Search ..... 162/199, 181.2, 181.3, 162/181.5, 79, DIG. 4

[56] References Cited

U.S. PATENT DOCUMENTS

| | | | |
|---|---|---|---|
| 4,268,351 | 5/1981 | Henbest et al. | 162/146 |
| 4,608,123 | 8/1986 | Leahy | 162/146 |
| 4,647,505 | 3/1987 | Blackie et al. | 428/396 |
| 4,756,801 | 7/1988 | Jokinen et al. | 162/175 |

FOREIGN PATENT DOCUMENTS

| | | |
|---|---|---|
| 122094 | 9/1980 | Japan . |
| 1268650 | 11/1986 | U.S.S.R. . |

OTHER PUBLICATIONS

Hassler, "Pitch Deposition in Papermaking & Function of Pitch Control Agents", Tappi Journal, pp. 195–201, Jun. 1988.

Magnesium Elektron Data Sheet 103A, "Zirconium Chemicals in the Paper Industry—An Introduction", (Mar. 1984)—4 pages.

McAlpine, *Paper Technology and Industry,* Jun./Jul. 1985, pp. 194–198.

Dickens, *Tappi Journal,* Dec. 1986, pp. 55–58.

Goldberg et al., *Tappi Proceedings,* 1987 Pulping Conference, pp. 585–596.

Rahman, *Tappi Journal,* Oct. 1987, pp. 105–112.

Carlisle Chemical Corp., "The Problem", 3 pages (undated).

Magnesium Elektron Data Sheet 500, "Zirconium Chemicals Product List", 6 pages (undated).

*Primary Examiner*—Karen M. Hastings

*Attorney, Agent, or Firm*—Panitch Schwarze Jacobs & Nadel

[57] ABSTRACT

The deposition of pitch on the machinery used in the pulping and papermaking processes and in the final paper produced in the papermaking process is prevented by adding an effective amount of a water-soluble zirconium(IV) compound to the aqueous system of a pulping and/or papermaking process to prevent the deposition of pitch on the machinery and in the final paper. The addition of an effective amount of a water-soluble zirconium(IV) compound to the aqueous system of the pulping and papermaking process also removes pitch deposits from the machinery used in the pulping and papermaking processes.

11 Claims, No Drawings

PROCESS FOR CONTROLLING PITCH DEPOSITS IN THE PULP AND PAPERMAKING PROCESSES WITH ZIRCONIUM (IV) COMPOUND

BACKGROUND OF THE INVENTION

1. Field of the Invention

This invention relates to a method for using water soluble zirconium(IV) compounds to prevent pitch deposition in the pulping and papermaking processes. One aspect of this invention pertains to a method for preventing the deposition of pitch on machinery used in the pulping and papermaking processes. Another aspect of this invention pertains to a method of preventing the formation of visible pitch particles in the final paper of a papermaking process. Yet another aspect of this invention pertains to a method for removing pitch deposits from machinery used in the pulping and papermaking processes.

2. Description of the Related Art

The problems caused by the build up of pitch on pulp and papermaking machinery and in the final paper cost the pulp and paper industry more than 30 million dollars a year in lost production. Pitch is generally considered to be a resin-based deposit of widely varying composition originating in the extractive fraction of wood. The extractive fraction of wood is one of the four principal components of wood. The other three are cellulose, lignin, and hemicellulose. The extractive fraction is defined as a complex mixture of substances which are soluble in cold water, alcohol, benzene, ether, and acetone. The extractive fraction, which makes up from about 3% to 10% of the weight of wood, contains such components as low molecular weight carbohydrates, terpenes, aromatic and aliphatic acids, alcohols, tannins, color substances, proteins, phlobaphenes, lignins, alkaloids, and soluble lignins. Pitch is a major problem in pulp and papermaking because it (1) agglomerates and also occludes other matter to form visible "dirt" in the final paper, (2) plates out and collects on machinery used in the pulp and papermaking process such as screens, filters, refining equipment, pulp washers, and the paper machine, and (3) reduces pulp brightness and brightness stability. The composition and amount of pitch deposited on pulp and papermaking machinery and in the final paper varies with the time of the year the trees are harvested, the type of wood, and the type of the pulping process. For example, wood pulped from trees cut in the early spring and fall causes more pitch problems than wood from trees cut at other times during the year. Pitch deposited in softwood Kraft mills tends to have a relatively larger abietic acid to fatty acid-ester ratio than pitch found in hardwood Kraft mills. Pitch deposit problems are somewhat more severe in sulfite mills. The sulfite pulping process removes only about one half of the resins and fatty esters leaving a considerable portion of these materials encapsulated within the cellulose fibers. However, these encapsulated materials are released by the shearing forces of the refining process and thus pitch deposits are more prevalent in the stock preparation area and on the paper machine. Pitch problems can be quite bothersome in mechanical pulp mills, including groundwood, TMP, CTMP, and semi-chemical pulping processes, particularly those that utilize softwoods. This is because there is little chemical degradation of the fatty acid esters and resin esters. Therefore, those materials are not washed out and tend to remain dispersed in the aqueous system of the pulping process.

The presence of calcium carbonate in the pulping process exacerbates the problem of pitch deposition on pulp and papermaking machinery. Crystallized calcium carbonate can provide nucleation sites for precipitated metal soaps thereby producing hydrophobic particles which coalesce with other particles to form a pitch deposit.

There have been many attempts over the years to eliminate pitch problems by employing pitch control agents in the pulp and/or papermaking processes. The most common methods involve the use of alum, talc, anionic pitch-control agents such as polynaphthalene sulfonates or modified lignosulfonates, cationic pitch control agents such as polyquaternary ammonium polymers, and nonionic surfactants. An example of the use of polyquaternary ammonium polymers as pitch control agents can be found in U.S. Pat. No.3,582,461 issued to S. A. Lipowski et al. The patent discloses the use of water soluble dicyandiamide-formaldehyde condensates to prevent pitch deposition on machinery used in pulp and papermaking processes. Examples of attempts to control pitch with other types of compounds or processes are found in U.S. Pat. Nos. 3,812,055; 3,895,164; 3,896,046; 3,992,249; 4,313,790. None of the above methods or compositions is completely effective in preventing pitch from depositing on machinery used in the pulping and papermaking processes. None of the above methods or compositions is completely effective in preventing pitch from depositing in the final paper produced in the pulping and papermaking processes. None of the above methods or compositions is effective at all in removing pitch deposits from machinery used in the pulping and papermaking processes during the operation of these processes. Pitch deposits are normally removed from the machinery used in the pulping and papermaking processes during shut down periods when the machinery is not in actual operation.

Zirconium chemicals have been used by the paper industry since the early 1960's principally as insolubilizers for binders in paper coatings. These coatings are applied to various paper grades such as offset, labels, and food packaging board to impart water resistance during printing or end use. The binders used to adhere the coatings to the sheets normally have poor water resistance and hence insolubilizers are required. Zirconium chemicals have also been used as immobilizers for aqueous coatings to prevent the migration of the binder into the interior of the sheet or to the surface from the interior. For example, when starch is used as a binder in an aqueous coating formulation, it tends to migrate towards the surface of the sheet if the sheet is dried too rapidly before the immobilization point of the starch is reached. The zirconium compounds, most notably ammonium zirconium carbonate (AZC), interact weakly with the hydroxyl groups of the starch forming a type of a network that is water insoluble. The use of zirconium(IV) compounds in the control of stickies is known in the art and has been described in the literature (Tappi Proceedings, 1987 Pulping Conf. p585). Stickies are certain deposits caused by organic materials used in paper and board converting operations and introduced into paper machine furnishes with recycled fibers also called secondary fiber. The word "stickies" is derived from the fact that the deposits cause sticking on wires, felts, and other parts of paper machines. Stickies are a diverse mixture of synthetic polymeric materials ranging from hot-melt and pressure-sensitive adhesives to binders and coatings for inks or wet strength resins. The polymeric materials range from polyethylene, to polybutadiene-styrene, to polyvinylacetate, to polyacrylates, just to name a few. It is believed that the zirconium compounds control the effects of the stickies by reducing the tackiness through the reaction of the hydrolyzed zirconium(IV) ion with oxygenated functional groups on the polymers that make up the stickies. The hydrolyzed zirconium(IV) ion crosslinks hydroxyl- and carboxyl-containing polymers through reaction with these functionalities to produce stickies particles that are less tacky. The reduced tack probably results from the agglomeration of small particles through reaction of surface oxygenated moieties and AZC.

SUMMARY OF THE INVENTION

In accordance with one aspect of the present invention there is provided a process for preventing the deposition of pitch on machinery used in the pulping and papermaking processes comprising adding an amount of a water-soluble zirconium(IV) compound to the aqueous system of a pulping or papermaking process effective to prevent said pitch from depositing on said machinery. In accordance with another aspect of the present invention there is provided a process for preventing the deposition of pitch in the final paper produced in the papermaking process comprising adding an amount of a water-soluble zirconium(IV) compound to the aqueous system of a pulping or papermaking process effective to prevent said pitch from depositing on said final paper. In accordance with yet another aspect of the present invention there is provided a process for removing pitch deposits from machinery used in the pulping and papermaking processes comprising adding an amount of a water-soluble zirconium(IV) compound to the aqueous system of a pulping or papermaking process effective to remove said pitch deposits from said machinery. The present invention provides a new and effective method of removing pitch deposits from machinery used in the pulping and papermaking processes during the operation of these processes. The present invention also provides a new and effective method of preventing pitch from depositing on the machinery used in the pulping and papermaking processes. The present invention further provides a new and effective method of preventing pitch from depositing in the final paper produced in the pulping and papermaking processes.

DESCRIPTION OF THE PREFERRED EMBODIMENTS

As used herein, the term "controlling pitch" or equivalent terms means the prevention, reduction or removal of pitch depositions on or from machinery used in the pulping and papermaking processes and the prevention or reduction of pitch deposition in the final paper produced thereby. The pitch control agent used in controlling pitch, namely, a water-soluble zirconium(IV) compound, may be used in varying amounts, depending on the type of control desired, the type of pitch involved, the amount of pitch on the machinery or the paper, the type of pulping or papermaking process involved, and other factors well known to those skilled in the art, based on the present disclosure.

The present invention is the result of the unexpected discovery that the build up of pitch on pulping and papermaking machinery and in the final paper can be prevented by the addition of a water-soluble zirconium(IV) compound to the aqueous system of a pulping and/or papermaking process Perhaps even more surprising was the discovery that pitch deposits already formed on pulping and papermaking machinery can be removed by the addition of a water-soluble zirconium(IV) compound to the aqueous system of a pulping and/or papermaking process. The present invention can be used to control pitch deposition in any conventional pulping process including the Kraft, sulfite, mechanical, thermomechanical, chemical-thermo-mechanical, semi-chemical, stone groundwood, and chip groundwood processes. Since pitch can collect on any and all parts of the machinery used in the pulping and papermaking processes, the machinery used in the pulping and papermaking processes is defined as all surfaces that contact the aqueous system of a pulping or papermaking process including, but not restricted to pipes, tanks, screens, meters, pumps, head boxes, foils, wires, felts, dryers, doctor blades, grinders, refiners and evaporators. Pitch can also deposit in the final paper of the papermaking process by itself or in combination with other matter to form visible pitch particles. Visible pitch particles are those particles that are apparent by visible examination of a sheet of paper using standard methods of detection. These methods include visual examination under U.V. light, after staining or dying the sheet with an appropriate stain or dye, and detection using image analysis.

The aqueous system of a pulping and/or papermaking process is defined as any water stream that comes in contact with cellulose pulp fibers in a pulping or papermaking process. This includes the water in digesters, blow tanks, washers, stock tanks, screens, bleaching equipment, evaporators, refiners, beaters, head boxes, and wire pits. It is essential to the operation of the present invention that the water soluble zirconium(IV) compound enter into the aqueous system of a pulping or papermaking process in order to prevent the formation of or remove pitch deposits from machinery. On the other hand, it is not crucial to the practice of the present invention how the water-soluble zirconium(IV) compound is introduced into the aqueous system of a pulping and/or papermaking process. Any method of introduction of the water-soluble zirconium(IV) compound into the aqueous system of a pulping and/or papermaking process can be used. For example, the water-soluble zirconium(IV) compound may even be added directly to the wood cellulose fibers before they come in contact with the aqueous system of a pulping or papermaking process. This method includes spraying an aqueous solution of a water-soluble zirconium(IV) compound directly onto wood chips prior to adding them to a digester in a chemical pulping operation. The water-soluble zirconium(IV) compound can also be added to the digester and any operation downstream of the digester in a pulping or chemical recovery operation including the blow tank, or the washing, screening, cleaning, thickening, bleaching or refining operations or liquor recovery system. The water-soluble zirconium(IV) compound may also be added to the stock preparation system. The stock preparation system includes the high density chest, the stock blending chest, the refiners, the machine chest, and the stuff box. The water-soluble zirconium(IV) compound may also be added to the wet end of a paper machine. The wet end of a paper machine begins with the fan pump and ends at the point where the sheet exits from the press section to enter the drier section.

Since it is the essence of the present invention that the presence of zirconium(IV) compound in the aqueous system of a pulping and/or papermaking process prevents the formation on or removes pitch deposits from machinery used in the pulping and papermaking processes and in the final paper produced in the papermaking process, it is essential that the zirconium(IV) compounds in the practice of this invention be water-soluble. Any one or a combination of water-soluble zirconium(IV) compounds can be used to prevent the formation of pitch deposits on machinery used in the pulping and papermaking process and in the final paper produced in the papermaking process or to remove pitch deposits from machinery used in the pulping and papermaking processes. Among the water-soluble (equivalent to about 0.00425 lbs. to about 0.425 lbs. of Zr(IV)) zirconium(IV) compounds suitable for use in the present invention are ammonium zirconium carbonate, zirconium acetate, zirconium acetylacetonate, zirconium nitrate, zirconium sulfate, potassium zirconium carbonate, zirconyl chloride, and zirconyl iodide.

In a preferred embodiment of the present invention, a water-soluble zirconium(IV) compound is introduced into the aqueous system of a papermaking process by adding an aqueous solution of a water-soluble zirconium(IV) compound into the blender immediately before the machine chest of a Fourdrinier paper machine that had a history of pitch deposition problems on the foils, Uhle boxes, press rolls, and doctor blades. After addition of the zirconium(IV) solution, no pitch deposits formed on any part of the paper machine as long as the effective level of zirconium(IV) compound was maintained in the machine chest. It is preferred that the aqueous solution of the water-soluble zirconium(IV) compound be a 17% solution of ammonium zirconium carbonate (AZC) in water. It is also preferred that the effective level of zirconium(IV) compound in the machine chest be from about 0.05 lbs. to about 5.00 lbs. of 17% aqueous AZC solution per ton of pulp in the machine chest.

In a most preferred embodiment of the present invention, a water soluble zirconium(IV) compound is introduced into the aqueous system of a pulping process by adding an aqueous solution of a water soluble zirconium(IV) compound into the water line of the fourth stage washer of a four stage rotary vacuum pulp washer line that had a history of pitch deposits on the decker take off board. After addition of the zirconium(IV) solution, no pitch deposits formed on any machinery in the pulping or papermaking process downstream of the fourth stage washer as long as the effective level of zirconium(IV) compound was maintained in the fourth stage of the washer line. It is most preferred that the aqueous solution of the water soluble zirconium(IV) compound be a 17% solution of ammonium zirconium carbonate (AZC) in water. It is also most preferred that the effective level of zirconium(IV) compound in the fourth stage washer be from about 0.1 pounds to about 5.0 lbs. of 17% aqueous AZC solution (equivalent to about 0.0085 lbs. to about 0.425 lbs. of Zr(IV)) per ton of pulp in the fourth stage washer. The following operative examples will serve to illustrate, but not limit the present invention. Examples 1–3 show that the laboratory pitch deposition test is predictive of actual results obtained on full scale pulping and papermaking equipment.

EXAMPLE I

Preparation of Synthetic Pitch

To about 2350.0 grams of tap water were added about 18.1 grams of Unitol DT-25 (a tall oil containing 72% fatty acids, 26% rosin acids, and 2% unsaponifiables, Union Camp) about 1.5 grams of Indulin C (sodium salt of Kraft pine lignin, Westvaco Chemicals) and about 1.8 grams of a 50% aqueous sodium hydroxide solution. The dispersion was heated with stirring to about 150° F. and the pH was adjusted to about 4.0 with 98% sulfuric acid.

EXAMPLE 2

Laboratory Evaluation of AZC as a Pitch Deposition Preventative Using Synthetic Pitch A metal coupon (1010 cold rolled steel or 316 stainless steel) measuring 2"×4"×0.032" was placed in a three liter beaker containing the synthetic pitch from Example 1. The contents of the beaker were heated to about 150° F. to about 160° F. for about one hour after which the metal coupon was removed, washed with distilled water, dried, and weighed. The difference in the weight of the coupon before and after immersion in the hot synthetic pitch dispersion was taken as the amount of pitch deposited. An experiment identical to that described above was run to determine the effect of AZC in preventing pitch deposition except that about 0.25 grams of a 35% aqueous AZC solution (0.0875 g solid AZC) was added to the synthetic pitch dispersion. The % reduction in pitch deposition in the two types of tests is given in Table 1.

TABLE 1

Percent Reduction in the Amount of Synthetic Pitch Deposited on Metal Coupons in Laboratory Pitch Deposit Test.

| Test # | Amount of 35% AZC Solution | % Reduction* in Pitch Deposition |
|---|---|---|
| 1 | 0 | 0 |
| 2 | 0.25 grams | 62 |

$$*\%\ \text{Reduction in pitch deposition} = \frac{\text{wt. of deposit without AZC} - \text{wt. of deposit with AZC}}{\text{wt. of deposit without AZC}} \times 100\%$$

EXAMPLE 3

Laboratory Evaluation of AZC as a Pitch Deposition Preventative Using Pitch from a Kraft Pulp Mill The procedure of Example 2 was repeated except that the synthetic pitch dispersion was replaced by a dispersion containing about 13.0 grams of pitch from a Kraft pulp mill dispersed in about 2350.0 grams of tap water. The pitch deposition data is given in Table 2.

TABLE 2

Percent Reduction in the Amount of Kraft Pulp Mill Pitch Deposited on Metal Coupons in Laboratory Pitch Deposit Test.

| Test # | Amount of 35% AZC Solution | % Reduction* in Pitch Deposition |
|---|---|---|
| 1 | 0 | 0 |
| 2 | 0.25 grams | 14 |

$$*\%\ \text{Reduction in pitch deposition} = \frac{\text{wt. of deposit without AZC} - \text{wt. of deposit with AZC}}{\text{wt. of deposit without AZC}} \times 100\%$$

EXAMPLE 4

Use of AZC to Prevent Pitch Deposition on Machinery Used in a Pumping Process A pulp washer had a history of pitch deposits on the decker take off board of the fourth stage of a four stage rotary vacuum washer line. A water-soluble zirconium(IV) compound was introduced into the aqueous system of a pulping process by adding a 17% aqueous solution of ammonium zirconium carbonate (AZC) to the water line of the fourth stage washer of the washer line. The treatment level was about 0.4 lbs. of AZC solution (equivalent to about 0.034 lbs of Zr(IV)) per ton of pulp in the washer. There were no pitch deposits on the decker take off board of the fourth stage washer after the addition of AZC had commenced and was maintained at the effective level.

EXAMPLE 5

Use of AZC to Prevent Pitch Deposition on Machinery Used in a Papermaking Process A Fourdrinier paper machine producing various grades of unbleached Kraft had a history of pitch deposits on the foils, Uhle boxes, press rolls, and doctor blades. A water-soluble zirconium(IV) compound was introduced into the aqueous system of the paper machine by adding a 17% aqueous solution of ammonium zirconium carbonate (AZC) to the blender immediately prior to the machine chest at a treatment level of about 0.35 to about 0.44 lbs. of solution (equivalent to about 0.0298 lbs. to about 0.0374 labs. of Zr(IV)) per ton of pulp in the blender. The AZC level was maintained in the blender for a period of seven days. During that time, no pitch deposits formed anywhere on any machinery downstream of the blender. Pitch deposits present on machinery downstream of the blender before the addition of the AZC were removed after the AZC was added.

EXAMPLE 6

Use of AZC to Prevent Pitch Deposition on Machinery Used in a Papermaking Process A Fourdrinier paper machine producing various grades of unbleached Kraft had a history of pitch deposits on the foils and flat boxes. A 17% aqueous solution of ammonium zirconium carbonate (AZC) was added to the blender immediately prior to the machine chest at a treatment level of about 2.5 to about 3.0 pounds of AZC solution (equivalent to about 0.2125 lbs. to about 0.255 lbs. of Zr(IV)) per ton of pulp in the blender. The AZC level was maintained in the blender for a period of seven days. During that time no pitch deposits formed anywhere on any machinery downstream of the blender.

EXAMPLE 7

Laboratory Evaluation of Various Zirconium(IV) Compounds as Pitch Deposition Preventives Using Synthetic Pitch The effectiveness of a number of zirconium(IV) compounds in controlling pitch deposition was determined according to the procedure described in Example 2 except that the pH of the synthetic pitch dispersion was adjusted to about 6.0. Approximately 0.079 g of a zirconium(IV) compound was used in each case. The relative effectiveness of the various zirconium(IV) compounds in preventing pitch deposition is given in Table 3.

TABLE 3

Relative Effectiveness of Some Zirconium(IV) Compounds in Preventing Pitch Deposition in Laboratory Pitch Deposit Test Using Synthetic Pitch

| Zirconium(IV) Compound added to Synthetic Pitch | % Reduction* in Pitch Deposition |
|---|---|
| None | 0 |
| AZC | 70 |
| Zirconium acetate | 31 |
| Zirconium acetylacetonate | 55 |
| Zirconyl chloride | 56 |
| Zirconium nitrate | 31 |

$$*\%\ \text{Reduction in pitch deposition} = \frac{\text{wt. of deposit without AZC} - \text{wt. of deposit with AZC}}{\text{wt. of deposit without AZC}} \times 100\%$$

EXAMPLE 8

Evaluation of AZC as a Pitch Deposition Preventative Using Pitch from a Sulfite Pulping Process The effectiveness of AZC in controlling the deposition of pitch from a pulp mill using the sulfite pulping process was determined according to the procedure described in Example 2 except that the synthetic pitch dispersion was replaced by a dispersion containing about 8.9g of pitch from a sulfite pulp mill dispersed in about 2350.0 grams of tap water. The pH of the dispersion was adjusted to about 6.0 and about 0.50 g of a 17.5% aqueous AZC solution was added to the pitch dispersion. The pitch deposition data is given in Table 4.

TABLE 4

Percent Reduction in the Amount of Sulfite Pulp Mill Pitch Deposited in Metal Coupons in Laboratory Pitch Deposit Test

| Test Number | Amount of 17.5% AZC Solution | % Reduction* in Pitch Deposition |
|---|---|---|
| 1 | 0 | 0 |
| 2 | 0.50 g | 67 |

$$*\%\ \text{Reduction in pitch deposition} = \frac{\text{wt. of deposit without AZC} - \text{wt. of deposit with AZC}}{\text{wt. of deposit without AZC}} \times 100\%$$

What is claimed is:

1. A process of controlling pitch present in pulping and papermaking processes comprising
   (a) formulating a pitch control agent consisting essentially of a water-soluble zirconium(IV) compound, and
   (b) adding the pitch control agent to a water stream that comes into contact with cellulose pulp fibers in the pumping and papermaking processes in an amount sufficient to reduce or remove the deposition of the pitch on machinery used in the pumping and papermaking processes and to reduce the deposition of the pitch in paper produced in the papermaking process, wherein the pitch is a naturally occurring resin-based deposit originating in an extractive fraction of wood used in the pumping and papermaking processes.

2. The process of claim 1 wherein step (b) comprises adding the pitch control agent in an amount of about 2.00425 lbs. to about 0.425 lbs. per ton of pulp, based on the weight of zirconium(IV) present.

3. The process of claim 1 wherein step (b) comprises adding the pitch control agent in an amount of about 0.0298 lbs. to about 0.255 lbs. per ton of pulp; based on the weight of zirconium(IV) present.

4. The process of claim 1 wherein the water-soluble zirconium(IV) compound is selected from the group consisting of ammonium zirconium carbonate, zirconium acetate, zirconium acetylacetonate, zirconium nitrate, zirconium sulfate, potassium zirconium carbonate, zirconyl chloride, zirconyl iodide and combinations thereof.

5. The process of claim 1 wherein the water-soluble zirconium(IV) compound is ammonium zirconium carbonate.

6. The process of claim 1 wherein step (b) comprises adding the pitch control agent in a pulping process or chemical recovery operation associated therewith in a location at or downstream of a digester.

7. The process of claim 1 wherein step (b) comprises adding the pitch control agent to a stock preparation system of a papermaking process comprising at least one of a high density chest, a stock blending chest, a refiner, a machine chest, or a stuff box.

8. The process of claim 1 wherein step (b) comprises adding the pitch control agent to a wet end of a paper machine used in the papermaking process.

9. The process of claim 1 wherein step (b) comprises adding the pitch control agent to a blender immediately before a machine chest of a Fourdrinier paper machine used in the papermaking process.

10. The process of claim 1 wherein step (b) comprises adding the pitch control agent into a water line of a last stage washer of a multi-stage rotary vacuum pulp washer used in the pulping process.

11. The process of claim 1 wherein the pulping and papermaking processes are selected from the group consisting of Kraft, sulfite, mechanical, thermo-mechanical, chemical-thermo-mechanical, semi-chemical, stone groundwood and chip groundwood processes.

* * * * *

UNITED STATES PATENT AND TRADEMARK OFFICE

CERTIFICATE OF CORRECTION

PATENT NO. : 4,950,361

DATED : August 21, 1990

INVENTOR(S) : Gregory W. Bender et al.

It is certified that error appears in the above-identified patent and that said Letters Patent is hereby corrected as shown below:

Column 8, lines 55,57 and 63;

In the Claims:

Claim 1, "pumping" should read --pulping--, all occurrences.

Signed and Sealed this

Twelfth Day of May, 1992

*Attest:*

DOUGLAS B. COMER

*Attesting Officer*

*Acting Commissioner of Patents and Trademarks*